United States Patent [19]

Brummans

[11] 3,977,754

[45] Aug. 31, 1976

[54] ELECTRICAL CONNECTOR

[75] Inventor: Wilhelmus Johannes Brummans, Sint-Michielsgestel, Netherlands

[73] Assignee: AMP Incorporated, Harrisburg, Pa.

[22] Filed: Dec. 5, 1974

[21] Appl. No.: 530,269

[30] Foreign Application Priority Data

Dec. 19, 1973 Netherlands ..... 7317390

[52] U.S. Cl. ..... 339/99 R; 339/95 D

[51] Int. Cl.[2] ..... H01R 9/08

[58] Field of Search ..... 339/95, 97–99, 339/273

[56] References Cited

UNITED STATES PATENTS

| | | | |
|---|---|---|---|
| 3,183,472 | 5/1965 | Pawl | 339/97 P |
| 3,778,750 | 12/1973 | Caveney et al. | 339/97 R |
| 3,820,055 | 6/1974 | Huffnagle | 339/97 P |

FOREIGN PATENTS OR APPLICATIONS

| | | | |
|---|---|---|---|
| 1,615,753 | 5/1970 | Germany | 339/273 F |
| 1,913,992 | 10/1970 | Germany | 339/97 R |
| 390,294 | 4/1933 | United Kingdom | 339/98 |

*Primary Examiner*—Joseph H. McGlynn
*Attorney, Agent, or Firm*—William J. Keating; Jay L. Seitchik; Frederick W. Raring

[57] ABSTRACT

An electrical connector includes slotted plate contacts which are received in cavities in a housing of insulating material. A stuffer forces wires successively into the slots of the slotted plate contacts when moved along a channel in the housing.

5 Claims, 3 Drawing Figures

ELECTRICAL CONNECTOR

The present invention relates to an electrical connector.

According to the present invention, an electrical connector comprises a housing of insulating material formed with a cavity in which is received an electrical contact, the electrical contact having a slot, the edges of the material defining the slot electrically engaging a wire when positioned in the slot, the housing having an aperture extending between an outside surface of the housing and the cavity and in general alignment with the slot for the passage therethrough of the wire, and a stuffer slidably received in a channel in the housing, the stuffer having a surface which, on movement of the stuffer along the channel is adapted to engage a wire when passed through the aperture and positioned in alignment with the slot, and move the wire along the slot.

An embodiment of the invention will now be described by way of example, reference being made to the Figures of the accompanying diagrammatic drawings in which.

As shown, an electrical connector 1 comprises a housing 2 of insulating material, at least one electrical contact 3 and a stuffer 4 of insulating material.

Figure 1:
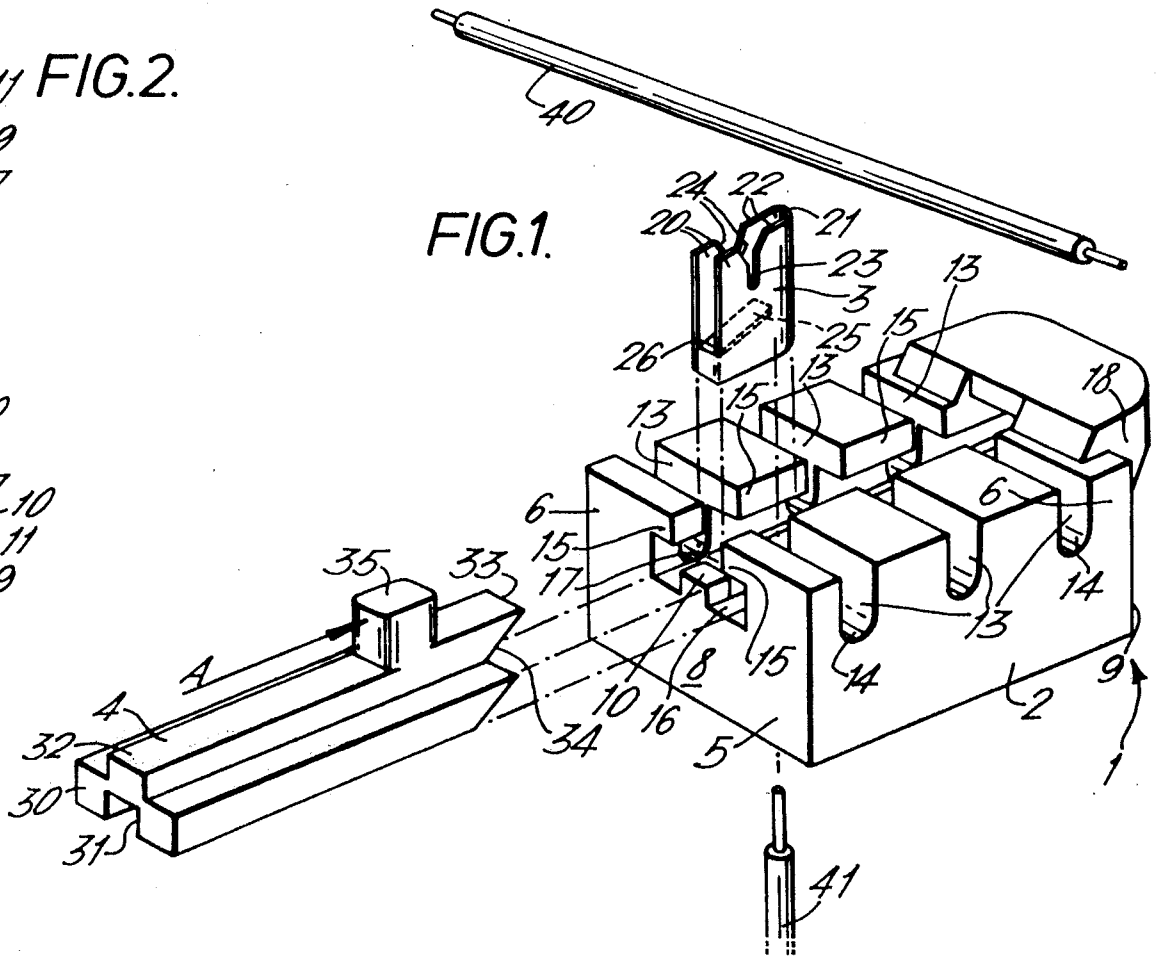
FIG. 1 is an exploded perspective view of an electrical connector.
Figure 2:
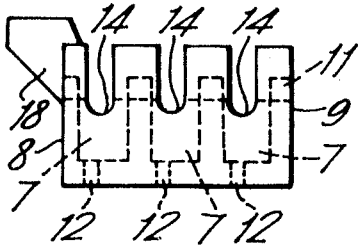
FIG. 2 is a side view of a housing forming part of the electrical connector of FIG. 1.
Figure 3:
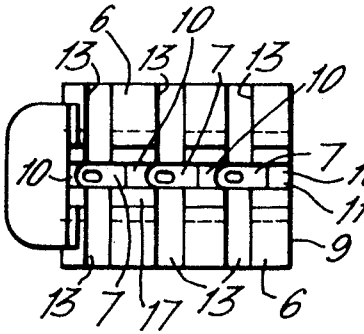
FIG. 3 is a plan view of the housing of FIG. 2.

The housing 2 has a generally rectangular base part 5 and a pair of opposed side walls 6 extending upwardly from the upper surface 16 (as shown in FIG. 1) of the base part 5. Generally mid-way between the side walls 6 a row of spaced cavities 7 is formed in the base part 5 which extends axially of the base part 5. Between adjacent cavities 7, and the end cavities and the respective end faces 8, 9 of the base part 5 are embossments 10 which, in effect, define a central interrupted rib 11. Holes 12 are formed in base part 5, each hole 12 communicating with a cavity 7.

Each side wall 6 has three apertures 13, each aperture 13 being in alignment with an aperture 13 in the opposite side wall 6 to form an aligned pair of apertures. The base 14 of each aligned pair of apertures communicates with a cavity 7. Each side wall 6 has a flange 15 which extends inwardly over the base part 5 and defines with the upper surface 16 of the base part 5 a channel 17 extending axially of the base part and laterally of the apertures 13.

A stop 18 is provided at the end face 8.

The electrical contact 3 is formed from sheet material and includes a pair of spaced, parallel sides 20 inter-connected by a bight portion 21. Each side has formed in one edge 22 a slot 23. Each slot 23 has a lead-in portion 24 immediately adjacent the edge 22 and the slots 23 are in alignment. A contact arm 25 extends from an edge 26 of one side 20 towards the bight portion 21 between the sides 20.

An electrical contact 3 is received in each cavity 7 so that the slots 23 are in alignment with an aligned pair of apertures 13. Further, the space between the free end of the contact arm 25 and the bight portion 21 is in general alignment with a hole 12.

The stuffer 4 is elongate and has a base 30 formed with a central longitudinally extending groove 31 in its lower surface and a longitudinally extending rib 32 on its upper surface (as shown). The forward end 33 of the stuffer 4 is formed with a cam surface 34 which tapers towards the forward end 33. The rib 32 has a boss 35.

When it is desired to interconnect two wires 40, 41, the wire 40 is first placed in an aligned pair of apertures 13 so that a portion of the wire 40 rests on the lead-in portions 24 of a contact 3. Next, the stuffer 4 is moved along the channel 17, force, if necessary being applied to the boss 35 as indicated by arrow A. The cam surface 34 engages and moves the wire 40 along the aligned slots 23 so that the edges of the material defining the slots electrically engage the wire 40, that is, pierce any insulation to engage the conductive core of the wire. The rib 11 engages in the groove 31 and guides the stuffer 4 during its movement along the channel 17. When inserted fully into the channel 17, the forward end 33 of the stuffer 4 engages the stop 18. The flanges 15 minimize the possibility of accidental release of the stuffer 4 from the channel 17.

The wire 41 has a prepared end with insulation removed to expose a conductive core which is threaded through the corresponding hole 12 and gripped resiliently between the contact arm 25 and the bight portion 21 of the contact 3.

When an electrical contact 3 is received in each cavity 7, and a corresponding wire 40 is to be connected to each contact 3, the stuffer 4 will engage successively each wire. This minimizes the maximum force required to move all the wires 40 along their respective slots 23. The stuffer also prevents accidental removal of a wire 40 from its respective slot 23.

The electrical connector described above is simple and economic to manufacture. Further, the electrical contacts 3 are preloaded in the housing 2 prior to use in an electrical circuit which minimizes assembly time on site. Finally, the connector 1 permits a rapid and economic electrical interconnection of two wires arranged in planes at right angles to each other.

Modifications can be made to the electrical contact 3. For example, the contact arm 25 can be replaced by a tubular socket extending from the bight portion 21. The tubular socket extends through a hole 12 and can act as a receptacle for a pin terminating the wire 41.

Alternatively, one side 20 can have connected to it, cutter plate so that the electrical contact 3 cuts excess wire 40 when the wire 40 and contact 3 are assembled together. In this situation, the wire 40 is, in effect, terminated by the contact 3.

I claim:

1. An electrical connector comprising an insulating housing having a cavity therein, a conductive contact member within the cavity having a slot therein, said slot extending inwardly of the contact member and having a slot entrance flaring outwardly, said housing having a first opening therethrough in alignment with the slot entrance for receiving a first conductor extending through the first opening and slot entrance, said housing further having a second opening normal to the first opening for passing the end of a second conductor therethrough, said housing having a linear channel therein, said contact member having means engageable with the second conductor for securing it to the contact member, and a stuffer element slidably supported within said linear channel and movable within the housing in a direction tangential to the first conductor, the forward most portion of the stuffer element including a cam surface for abutting and moving the first conductor into the slot as the stuffer moves thereover.

2. An electrical connector comprising an insulating housing having a plurality of transversely spaced cavities formed therein, a conductive contact member having a slot therein, one of said contact members being located in each of said cavities, said housing having a plurality of openings therethrough each in alignment with the entrance to a respective slot, each opening being for receiving a conductor extending through the opening and respective slot entrance, and a stuffer element movable within the housing in a direction tangential to the conductors and bearing thereagainst and being successively movable over the conductors in the slot entrances for forcing the conductors into firm electrical contact with their respective slot wall.

3. An electrical conductor according to claim 2 wherein the forwardmost portion of the stuffer includes a cam surface for abutting and moving the conductor into the slot as the stuffer moves thereover.

4. An electrical conductor according to claim 3 wherein each contact member is of sheet metal bent upon itself to provide a pair of transversely spaced walls, said slot being provided in each of said walls and in alignment with each other.

5. An electrical conductor according to claim 4 wherein the housing is provided with a second opening normal to each of the first openings in registry with the space between the contact walls for passing the end of a conductor thereinto, and resilient means attached to one of said walls within the space therebetween, for maintaining the conductor in electrical engagement with the contact member.

* * * * *